US005388339A

United States Patent [19]

Roach et al.

[11] Patent Number: 5,388,339

[45] Date of Patent: Feb. 14, 1995

[54] TRI-SQUARE PROTRACTOR

[76] Inventors: Daniel F. Roach, 1230 St. Lawrence Ave., Bronx, N.Y. 10472; George Spector, 233 Broadway Rm. 3815, New York, N.Y. 10007

[21] Appl. No.: 760,686

[22] Filed: Sep. 16, 1991

[51] Int. Cl.[6] ..... B43L 7/12

[52] U.S. Cl. ..... 33/419; 33/424; 33/426; 33/480

[58] Field of Search ..... 33/419, 424, 426, 427, 33/428, 429, 464, 468, 474, 479, 480, 555.3, 529

[56] References Cited

U.S. PATENT DOCUMENTS

| | | | |
|---|---|---|---|
| 535,223 | 3/1895 | Rowell | 33/428 |
| 686,891 | 11/1901 | Dunbar | 33/428 |
| 798,721 | 9/1905 | Wilson | 33/468 |
| 813,173 | 2/1906 | Realing | 33/419 |
| 965,312 | 7/1910 | Meeker | 33/419 |
| 1,337,823 | 4/1920 | Crane | 33/427 |
| 1,657,547 | 1/1928 | Paulson | 33/427 |
| 2,085,461 | 6/1937 | Chafeee | 33/428 |
| 2,536,378 | 1/1951 | Lee | 33/427 |
| 3,456,353 | 7/1969 | Iams | 33/429 |
| 4,380,872 | 4/1983 | Moran | 33/529 |

*Primary Examiner*—Thomas B. Will

[57] ABSTRACT

An improved combination square set is provided. It has a square head, a center head, a protractor head and a blade. The improvement is the blade which can be a grooved L-square rule, a grooved T-square rule, a grooved try square and a grooved flat straight rule, so that the improved combination square set can be used to measure and mark quadrants on round stock, the angle of a drill press table and angles on a flat board.

1 Claim, 2 Drawing Sheets

TRI-SQUARE PROTRACTOR

BACKGROUND OF THE INVENTION

The instant invention relates generally to measuring tools and more specifically it relates to an improved combination square set which provides a mechanism that can be used to measure and mark round stock, the angle of a drill press table and angles on a flat board.

There are available various conventional measuring tools which do not provide the novel improvements of the invention herein disclosed.

SUMMARY OF THE INVENTION

A primary object of the present invention is to provide an improved combination square set that will overcome the shortcomings of the prior art devices.

Another object is to provide an improved combination square set which is a versatile tool that can be used to measure and mark quadrants on round stock, the angle of a drill press table and angles on a flat board.

An additional object is to provide an improved combination square set that can be used to measure and mark predetermined angles longitudinally and latitudinally in the quadrants on the round stock.

A further object is to provide an improved combination square set that is simple and easy to use.

A still further object is to provide an improved combination square set that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
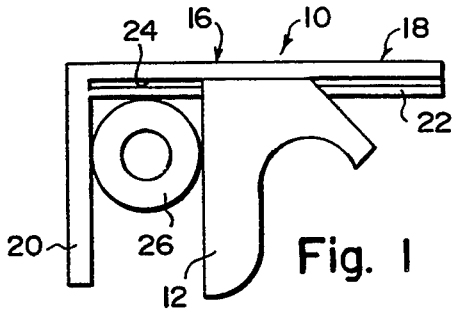
FIG. 1 is a diagrammatic view of a square head and a grooved L-square rule measuring the exterior of a round pipe.
Figure 2:
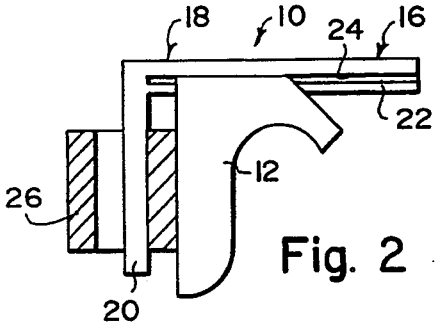
FIG. 2 is similar to FIG. 1, measuring the thickness of a wall of the pipe.
Figure 6:
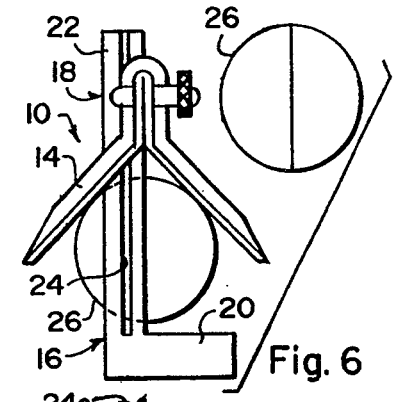
FIGS. 6 and 7 are diagrammatic views of a center head with the grooved L-square rule dividing a piece of round stock into right angle quadrants.
Figure 7:
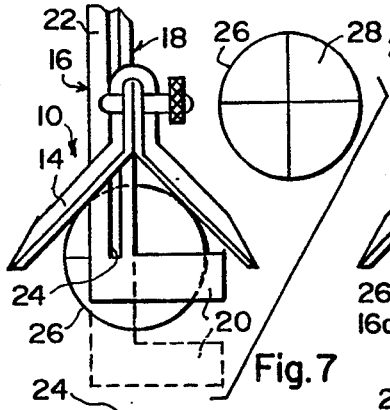

Turning now descriptively to the drawings, in which similar reference characters denote similar elements throughout the several views, FIGS. 1, 2, 6 and 7 illustrate an improved combination square set 10 of the type having a square head 12, a center head 14 and a blade 16. The improvement comprises the blade 16 being an L-square rule 18 with a short arm 20 and a long arm 22 having a longitudinal groove 24 therealong. When the square head 12 in FIGS. 1 and 2 are adjustably attached within the groove 24 in the long arm 22 of the L-square rule 18, a measurement of the exterior of a piece of round stock/pipe 26 and the measurement of the thickness of a wall of the piece of pipe 26 can be taken. When the center head 14 in FIGS. 6 and 7 are adjustably attached within the groove 24 in the long arm 22 of the L-square rule 18, the piece of round stock 26 can be divided into right angle quadrants 28.

Figure 3:
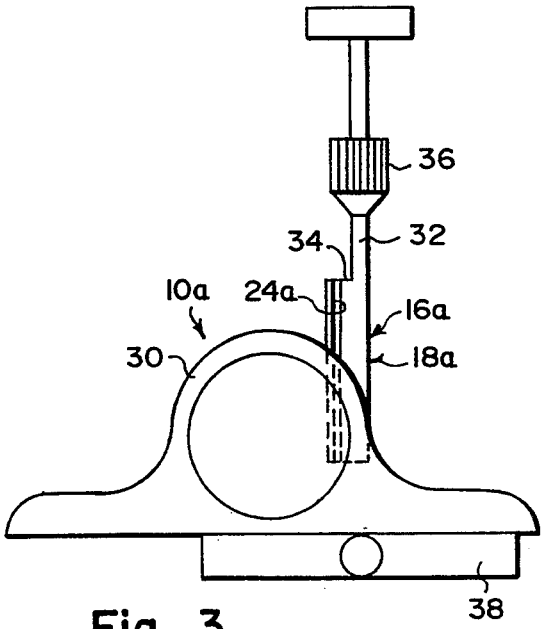
FIG. 3 is a diagrammatic view of a protractor head and a groove flat straight rule with a shaft portion to measure the angle between a drill press spindle chuck and a drill press table.
Figure 4:
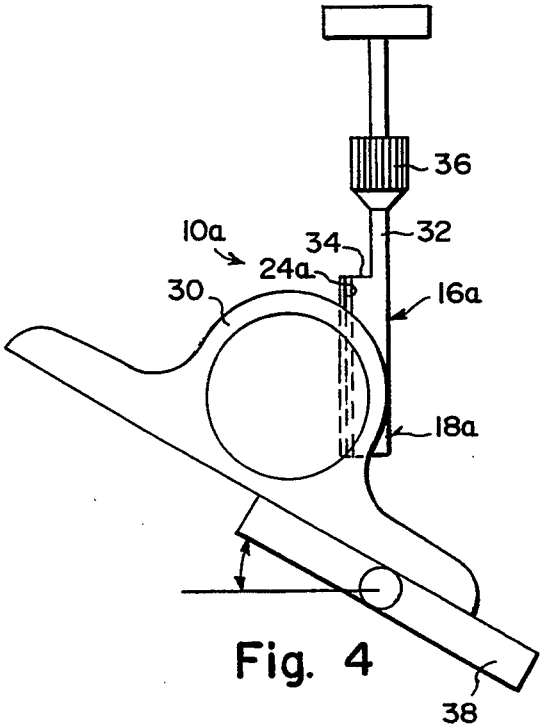
FIG. 4 is similar to FIG. 3 with the table tilted to a given degree.

The improved combination square set **10*a* in FIGS. 3 and 4 is of the type having a protractor head 30 and a blade 16*a*. The improvement comprises the blade 16*a* being a flat straight rule 18*a* having a longitudinal groove 24*a* therealong with a shaft portion 32 extending from one end 34 of the flat rule 18*a*. When the protractor head 30 is adjustably attached within the groove 24*a* in the flat rule 18*a* and the shaft portion 32 is inserted within a drill press spindle chuck 36, the protractor head 30 can measure the angle of a drill press table 38**.

Figure 5:
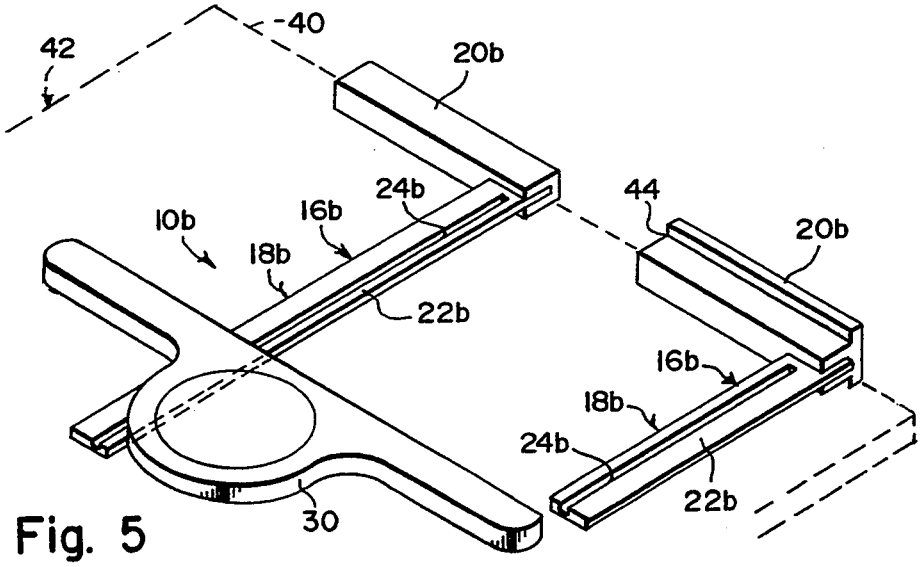
FIG. 5 is a diagrammatic perspective view of the protractor head and a grooved try square, with another try square having a stepped edge to be used as a border guide along an edge of a flat board.

The improved combination square set **10*b* in FIG. 5 is of the type having a protractor head 30 and a blade 16*b*. The improvement comprises the blade 16*b* being a try square 18*b* with a short arm 20*b* and a long arm 22*b* having a longitudinal groove 24*b* therealong. When the protractor head 30 is adjustably attached within the groove 24*b* in the long arm 22*b* of the try square 18*b*, the short arm 20*b* can slide along an edge 40 of a flat board 42 to allow the protractor head 30 to measure a desired line of an angle on the flat board 42. The short arm 20*b* of the try square 18*b*, can further have a stepped edge 44 to be used as a border guide along the edge 40 of the flat board 42**.

Figure 8:
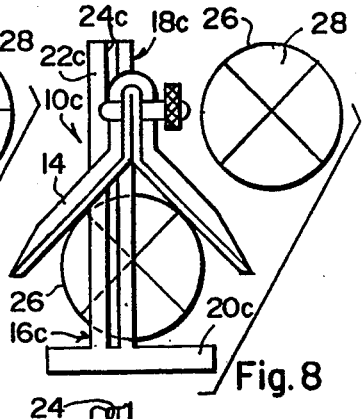
FIGS. 8 and 9 are diagrammatic views of a center head with a T-square rule dividing a piece of round stock into right angle quadrants and chords.
Figure 9:
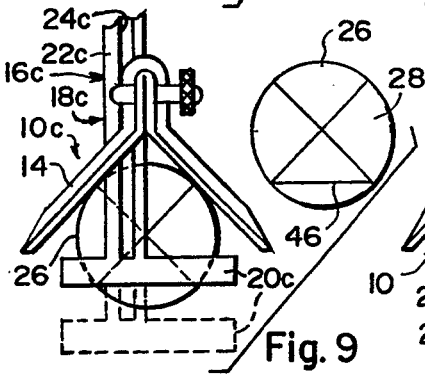

The improved combination square set **10*c* in FIGS. 8 and 9 are of the type having a center head 14 and a blade 16*c*. The improvement comprises the blade 16*c* being a T-square rule 18*c* with a short arm 20*c* and a long arm 22*c* having a longitudinal groove 24*c* therealong. When the center head 14 is adjustably attached within the groove 24*c* in the long arm 22*c* of the T-square rule 18*c*, the piece of round stock 26 can be divided into right angle quadrants 28 and chords 46**.

Figure 10:
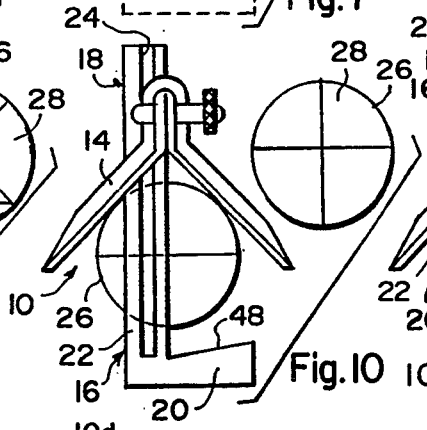
FIGS. 10 and 11 are diagrammatic views of a center head with a grooved L-square rule having an upper edge of its short arm set at a predetermined angle to indicate longitudinally in anyone of the quadrants the predetermined angle.
Figure 11:
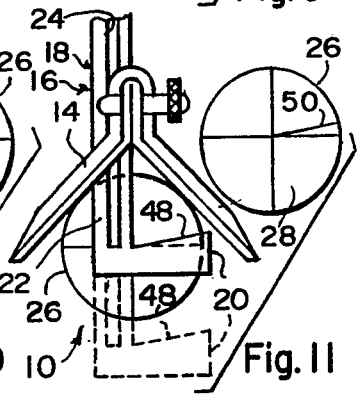

The improved combination square set 10 in FIGS. 10 and 11, shows the short arm 20 of the L-square rule 18 further having its upper edge 48 set at a predetermined angle so that the predetermined angle can be indicated longitudinally at 50 in any one of the quadrants 28 on the piece of round stock 26.

Figure 12:
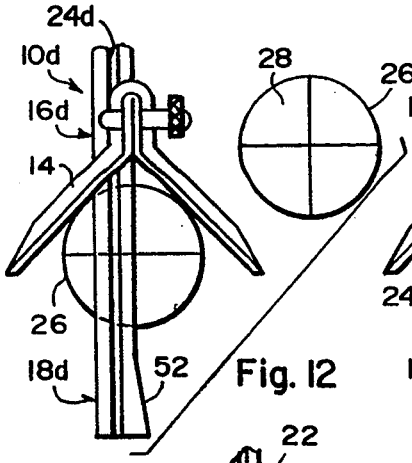
FIG. 12 and 13 are diagrammatic views of a center head with a grooved flat straight rule having a portion of a right edge set at a predetermined angle to indicate latitudinally in anyone of the quadrants the predetermined angle.
Figure 13:
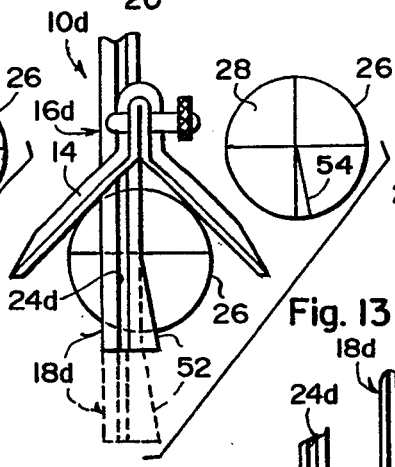

The improved combination square set 10*d* in FIGS. 12 and 13 are of the type having a center head 14 and a blade 16*d*. The improvement comprises the blade 16*d* being a flat straight rule 18*d* having a longitudinal groove 24 therealong with a portion 52 of a right edge of the flat straight rule 18*d* set at a predetermined angle, so that the predetermined angle can be indicated latitudinally at 54 in anyone of the quadrants 28 on the piece of round stock 26.

Figure 14A:
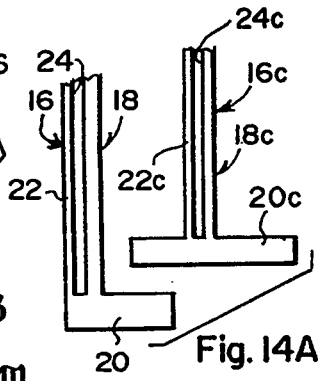
FIG. 14A is a diagrammatic view of the L-square rule and the T-square rule per se.
Figure 14B:
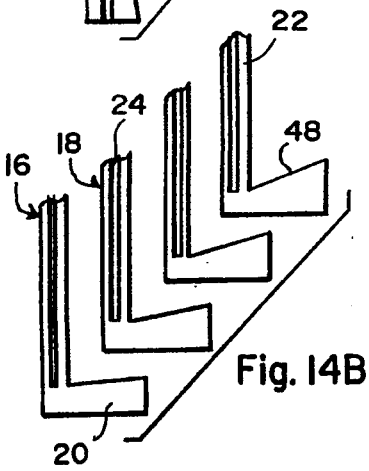
FIG. 14B is a diagrammatic view showing a plurality of L-square rules with different predetermined angles on the upper edges of the short arms.
Figure 14C:
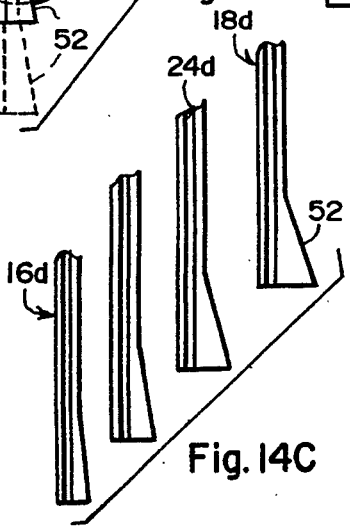
FIG. 14C is a diagrammatic view showing a plurality of flat straight rules with different predetermined angles on a portion of the right edges.

FIGS. 14A, 14B and 14C are diagramatic views of the T-squares, L-squares, L-squares with angled edges and flat straight rules with angled right edges per se of FIGS. 9–13 with the corresponding reference numerals.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An improved combination square set of the type having a protractor head and blade, wherein the improvement comprises the blade being a tri-square with a short arm with a guide surface normal to a long arm having a longitudinal groove thereon, so that when the protractor head is adjustably attached within said groove on said long arm of said tri-square the short arm can slide along an edge of a flat board, to allow the protractor head to measure a desired line of an angle on the flat board; wherein said short arm of said tri-square further having a stepped edge parallel to said guide surface to be used as an additional border guide along the edge of the flat board.

* * * * *